US006162388A

United States Patent [19]

Huin et al.

[11] Patent Number: 6,162,388

[45] Date of Patent: Dec. 19, 2000

[54] METALLURGICAL REACTOR FOR THE TREATMENT UNDER REDUCED PRESSURE OF A LIQUID METAL

[75] Inventors: Didier Huin, Nancy; Hubert Saint Raymond, Metz; François Stouvenot, Labry, all of France

[73] Assignee: Sollac, Puteaux, France

[21] Appl. No.: 09/207,762

[22] Filed: Dec. 9, 1998

[30] Foreign Application Priority Data

Dec. 22, 1997 [FR] France ..... 97 16453

[51] Int. Cl.[7] ..... C21C 7/10

[52] U.S. Cl. ..... 266/209; 266/217

[58] Field of Search ..... 266/208, 209, 266/210, 211, 216, 217

[56] References Cited

U.S. PATENT DOCUMENTS

| | | | |
|---|---|---|---|
| 3,022,059 | 2/1962 | Harders | 266/210 |
| 3,798,025 | 3/1974 | Ramachandran et al. | 266/210 |
| 3,820,767 | 6/1974 | Metz | 266/216 |
| 4,298,376 | 11/1981 | Narita et al. | 266/209 |

FOREIGN PATENT DOCUMENTS

| | | |
|---|---|---|
| 0 366 293 | 5/1990 | European Pat. Off. . |
| 58-181818 | 10/1983 | Japan . |
| 59-025919 | 2/1984 | Japan . |
| 61 130415 | 6/1986 | Japan . |

OTHER PUBLICATIONS

French Search Report Sep. 1998.

*Primary Examiner*—Scott Kastler
*Attorney, Agent, or Firm*—Nixon Peabody LLP; Thomas W. Cole

[57] ABSTRACT

The invention relates to a metallurgical reactor for the treatment under reduced pressure of a liquid metal (1) such as steel, contained in a ladle (2), of the type comprising a chamber (25), connected to a gas-suction plant (30) which can maintain a reduced pressure therein, and two tubular snorkels (26, 27), the upper ends of which emerge in orifices (35, 36) made in the bottom (28) of the chamber (25) and the lower ends of which may be immersed in said liquid metal (1) contained in said ladle (2), one (26) of said snorkels, called the "ascending snorkel", having means (29) for injecting a gas into its internal space for the purpose of creating a circulatory motion in the liquid metal (1) between the ladle (2) and the chamber (25) during said treatment, the reactor also comprising an enclosure (17) which is provided with means (20) for injecting a gas into its internal space, these means being suitable for creating a pressure greater than atmospheric pressure in the enclosure (17), and the ladle (2) being placed in the latter, the upper edge (23) of said enclosure being designed to support the bottom (28) of the chamber (25) in a sealed manner during said treatment, and means (18, 19) for raising the ladle (2) toward the chamber (25) during said treatment.

9 Claims, 2 Drawing Sheets

METALLURGICAL REACTOR FOR THE TREATMENT UNDER REDUCED PRESSURE OF A LIQUID METAL

BACKGROUND OF THE INVENTION

The invention relates to the smelting of metals in the liquid state, especially steel. It applies particularly to the smelting of high-purity steels of extremely low carbon content, or even also of extremely low nitrogen, hydrogen and oxygen content.

DESCRIPTION OF THE PRIOR ART

At the present time, it is commonplace to use vacuum reactors of the so-called "RH" type when smelting liquid steel. It will be recalled that these reactors are composed of:

- a tall chamber of roughly cylindrical shape, coated on the inside with refractories, and the upper part of which chamber is connected to a gas-suction plant capable of maintaining a reduced pressure in this chamber, this pressure possibly falling to as low as 1 torr or less when the reactor is in operation (the reader is reminded that 1 torr≈133 Pa or $1.33\times10^{-3}$ bar);
- two tubular snorkels made of refractory material, of circular or oval cross section, which are connected to the chamber via their upper end; one of these snorkels is provided with a device allowing a gas, usually argon, to be injected into its internal space.

These plants are used as follows. The ladle containing the liquid metal to be treated is brought beneath the RH reactor and the lower ends of the snorkels are immersed into it. After this, a vacuum is created in the chamber, thereby causing a certain amount of metal to be sucked up into the chamber by rising up inside the snorkels. The difference in level between the surfaces of the liquid metal in the ladle and in the chamber is equal to the ferrostatic height corresponding to the pressure difference between the external environment and the inside of the chamber. Finally, gas begins to be injected into the snorkel equipped for this purpose. The function of this injection is to drive the metal in this snorkel toward the chamber—this is why this snorkel is called the "ascending snorkel". The metal passing through the chamber then comes back down into the ladle passing through the other snorkel—the so-called "descending snorkel". Thus metal continuously circulates between the ladle and the chamber. Throughout the duration of the treatment (i.e. generally between about ten and thirty minutes) any given portion of metal therefore resides several times inside the chamber. Their average residence time depends on the rate of circulation of the metal in the snorkels and on the ratio of the volume of the chamber to the volume of the ladle (this ratio generally ranges from about 1:10 to 1:20). Passing liquid metal into the chamber maintained under vacuum mainly allows its dissolved-hydrogen content to be decreased and, to a lesser extent, its dissolved-nitrogen content. The other metallurgical operations likely to occur in the chamber are:

- partial decarburization, by carbon in the form of CO combining with the oxygen which is already dissolved in the metal or which is injected into it for this purpose by a lance or by nozzles inserted into the wall of the chamber;
- addition of alloying elements, which is thus carried out in the absence of air and of the ladle slag, and therefore with optimum yield;
- reheating of the metal by the thermit process—aluminum is added to the metal, oxygen is then injected into it and the resulting oxidation of the aluminum causes this reheating.

At the same time, the circulation of metal between the ladle and the chamber causes gentle in-ladle stirring of the metal, this being conducive to non-metallic inclusions settling out properly.

Reactors of the type called "DH" are also used, although less commonly nowadays. They are distinguished from RH reactors in that their chamber is connected only to a single snorkel, via which some of the liquid metal contained in the ladle is sucked up into the chamber in order to be exposed to the reduced pressure therein. The metal present in the chamber is replenished periodically, either by temporarily interrupting the process of maintaining a reduced pressure in the chamber, which has the effect of sending the liquid metal contained in the chamber back in this way into the ladle, or by moving the ladle away from the chamber, with the pressure in the chamber remaining constant, which likewise causes metal to be sent back in this way into the ladle since the difference in level between the surfaces of the metal in the ladle and in the chamber must remain constant. It is not necessary to inject gas into these DH reactors; nevertheless, it is strongly recommended to do so if it is wished to promote the desired degassing and, optionally, decarburizing metallurgical reactions in the most effective manner.

In recent years there has been an increase in the demand from steel-consuming industries for iron and steel products with an extremely low carbon content (less than 50 ppm), particularly for cold-rolled sheet of high ductility and high tensile strength, for steel for deep drawing and for packaging, for ferritic chromium-molybdenum stainless steel, etc. The RH reactor has quickly become the in-ladle metallurgy reactor best suited to obtaining such steels under industrial conditions since the decarburization kinetics in it are favorably influenced by the massive injection of gas into the ascending snorkel, or even also into the chamber. Thus, for a ladle containing 300 t of liquid steel, an RF chamber containing 15 t and a rate of circulation of 240 t/min., a treatment time of 10 minutes may be enough to lower the carbon content in the steel from 300 ppm to 20 ppm. Plants in which the steel ladle is simply placed in an enclosure under reduced pressure (so-called "in-vessel vacuum" plants) or is covered by a lid below which a reduced pressure is maintained are not as well suited for this purpose. It is not possible to inject very large amounts of gas into them in order to speed up the decarburization kinetics, and exposing the ladle refractories, which often contain carbonaceous materials, to the vacuum promotes recarburization of the metal by these refractories.

DH reactors, if argon is injected into the snorkel, are also quite well suited to the production of steels having carbon contents of less than 50 ppm.

The growth in the demand for steels of increasingly high purity will probably require, in the very near future, being able commonly to obtain even lower carbon contents (5 to 10 ppm) with a productivity at least equivalent to that of the current plants (approximately 10 t/min. in large integrated works) However, in conventional RH and DH reactors, a marked slowing down of the decarburization reaction is observed when the average carbon content of the liquid steel becomes less than 30 ppm. Appreciably increasing these kinetics in the field of very low carbon contents would allow the desired metallurgical performance to be achieved in a time which is still compatible with optimum operation of the other workshops in the steelworks. However, this would be conceivable only by considerably increasing the rate of metal circulation and the amounts of gas injected into the various regions of the reactor. This would result in the inside of the vacuum chamber being very rapidly fouled by splashes of metal and in the refractories of the snorkels undergoing excessively accelerated wear, and hence in the plant being stopped more frequently and operating less reliably. In addition, a substantial increase in the amount of gas injected would require the capacity of the gas-suction plant to be increased, which is already considerable, with the risk of not being able to achieve sufficiently low pressures. In the end, to obtain carbon contents of substantially less than 10 ppm in an industrial environment under satisfactory technical and economic conditions seems difficult to achieve using a conventionally designed RH or DH reactor.

Obtaining as low a carbon content as possible in the liquid steel is all the more important since the steel will have many opportunities to recarburize in the subsequent smelting and casting operations, for example when it is continuously cast in contact with the refractories and the coverage powders of the tundish and of the mould.

Another drawback with conventionally designed RH and DH reactors is that they are not always satisfactorily sealed with respect to the ambient atmosphere at the snorkels (the refractories of which somewhat porous) and at the points where they are connected to the bottom of the chamber. The air which gets sucked in as a result may be estimated as being several hundreds of $Nm^3/h$ in large industrial plants. This air results in an uncontrolled influx of oxygen and nitrogen into the liquid metal, making it more difficult to control the decarburization and limits the extent to which the steel can be denitrided. What is more, a not insignificant portion of the capacity of the suction plant is devoted to extracting these undesirable gases, whereas it would more usefully be employed in extracting gas resulting from degassing and decarburizing the liquid steel, or which were conducive to this degassing and decarburization.

It has already been proposed (document JP-A-58,181,818) to make a sealed connection between the upper rim of the ladle and a flange integral with the chamber of the RH reactor. Injecting gas for pressurizing the surface of the liquid steel in the ladle increases the rate of metal recirculation between the ladle and the chamber, thereby improving the effectiveness of the degassing. Air is also prevented from being drawn into the snorkels. However, these modifications would not be sufficient to ensure as thorough and as rapid a decarburization as might be desired.

SUMMARY OF THE INVENTION

The object of the invention is to provide a novel type of metallurgical reactor which particularly allows carbon contents in the liquid steel of the order of 10 ppm and less to be achieved under satisfactory productivity conditions. This reactor should also be able to be used for producing steels with low or very low nitrogen and oxygen contents, just as in conventionally designed RH and DH reactors.

For this purpose, the subject of the invention is a metallurgical reactor for the treatment under reduced pressure of a liquid metal, such as steel, contained in a ladle, of the type comprising a chamber, connected to a gas-suction plant which can maintain a reduced pressure therein, and two tubular snorkels, the upper ends of which emerge in orifices made in the bottom of the chamber and the lower ends of which may be immersed in said liquid metal contained in said ladle, one of said snorkels, called the "ascending snorkel", having means for injecting a gas into its internal space for the purpose of creating a circulatory motion in the liquid metal between the ladle and the chamber during said treatment, the reactor also comprising an enclosure which is provided with means for injecting a gas into its internal space, these means being suitable for creating a pressure greater than atmospheric pressure in the enclosure, and the ladle being placed in the latter, the upper edge of said enclosure being designed to support the bottom of the chamber in a sealed manner during said treatment, and means for raising the ladle toward the chamber during said treatment.

The subject of the invention is also a metallurgical reactor for the treatment under reduced pressure of a liquid metal, such as steel, contained in a ladle, of the type comprising a chamber connected to a gas-suction plant able to maintain a reduced pressure therein, and one tubular snorkel, the upper end of which emerges in an orifice made in the bottom of the chamber and the lower end of which may be immersed in said liquid metal contained in said ladle, the reactor also comprising an enclosure which is provided with means for injecting a gas into its internal space, these means being suitable for creating a pressure greater than atmospheric pressure in the enclosure, and the ladle being placed in the latter, the upper edge of said enclosure being designed to support the bottom of the chamber in a sealed manner during said treatment, and means for raising the ladle toward the chamber during said treatment.

As will have been understood, the metallurgical reactor according to the invention is distinguished from conventional RH or DH vacuum-chamber reactors essentially by the fact that the ladle, instead of being simply in the open air, is placed in an enclosure on the upper edge of which rests, in a sealed manner, the bottom of the vacuum chamber. The vessel is inerted by means of an inert gas which pressurizes it to a pressure substantially greater than atmospheric pressure so as to cause the maximum amount of liquid metal to rise up into the vacuum chamber.

BRIEF DESCRIPTION OF THE DRAWINGS

The invention will be more clearly understood on reading the following description, given with reference to the following appended figures:

FIG. 2 which shows a plant for the vacuum treatment of liquid steel according to the invention.

DESCRIPTION OF THE PREFERRED EMBODIMENTS

Figure 1:
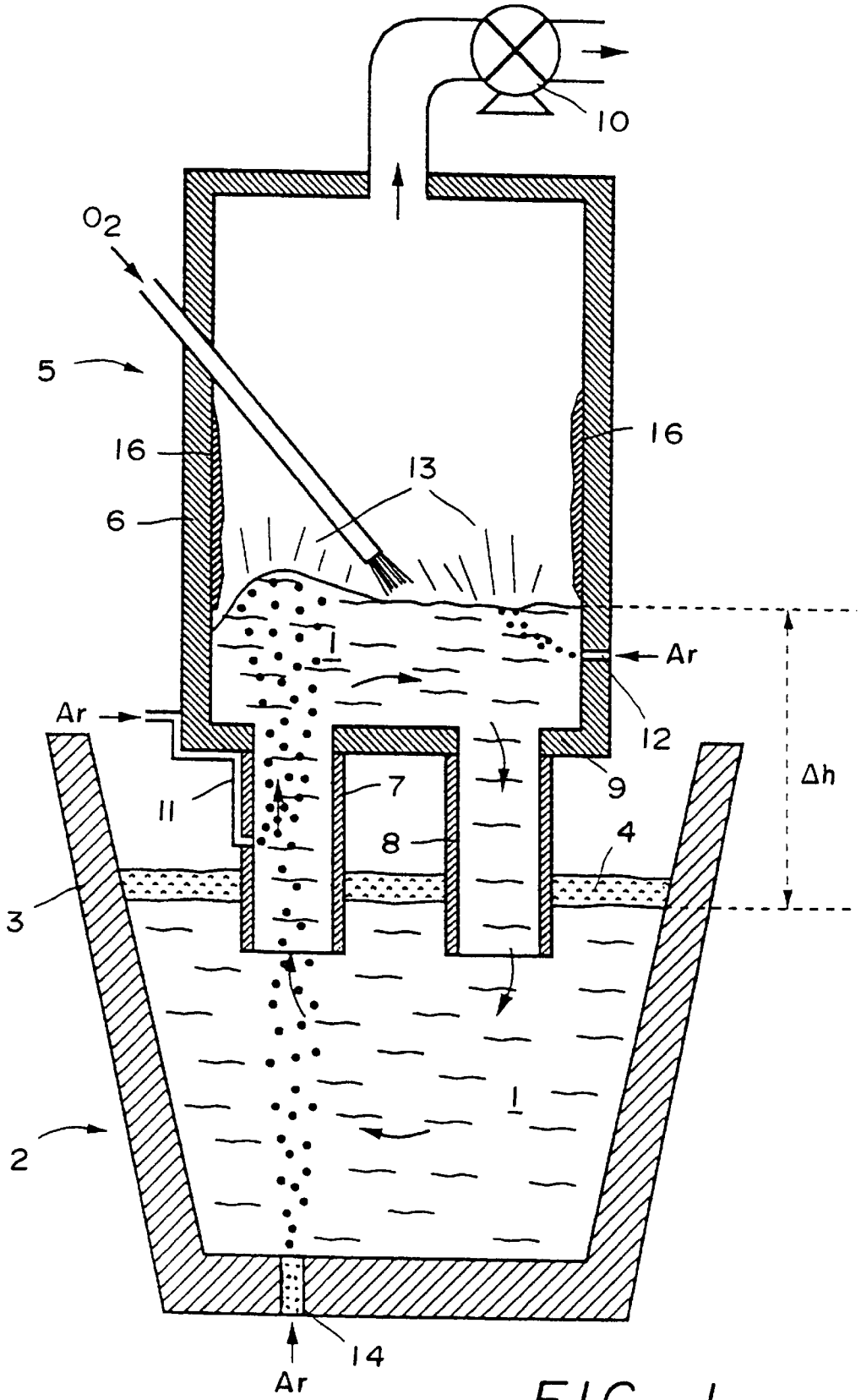
FIG. 1 which shows, seen in longitudinal section, by way of reference, an RH-type plant for the vacuum treatment of liquid steel, representative of the art prior to the invention.

In the conventional RH-type vacuum treatment plant in FIG. 1, the liquid steel 1 is contained in a ladle 2 which is coated on the inside with a layer of refractories 3 and is exposed to the atmospheric pressure $P_{atm}$. A layer of slag 4 floats on the surface of the liquid steel 1 and insulates it from the ambient atmosphere. The RH reactor itself is composed of a chamber 5 coated on the inside with refractories 6 and of two tubular snorkels 7, 8 made of refractory material, of cylindrical general shape, which are connected to the bottom 9 of the chamber 5. The top of the chamber 5 is connected to a gas-suction plant 10, such as a battery of vapor ejectors. At the start of the treatment, the chamber 5 is placed above the ladle 1 and, by moving the chamber 5 relative to the ladle 2 or vice versa, the lower ends of the snorkels 7, 8 are made to dip into the liquid steel 1. A reduced pressure $P_{chamber}$ is established in the chamber 5 using the suction plant 10. This has the effect of sucking up liquid metal 1 into it via the snorkels 7, 8. Next, a gas is injected into one of the snorkels 7 by means of a pipe 11 emerging in the internal space of said snorkel 7. This gas is preferably an inert gas, such as argon, insoluble in liquid steel. The flow rate of the gas is generally about 4 to 12 litres per minute and per metric ton of steel to be treated. It creates an ascending circulatory motion in the snorkel 7 (which for this reason is called the "ascending snorkel"). This motion has the effect of causing an amount of liquid metal 1 equivalent to that which enters the chamber 5 via the ascending snorkel 7 to come back down from the chamber 5 into the ladle 2 via the other snorkel 8 (called the "descending snorkel"). The liquid steel 1 thus continuously circulates between the ladle 2 at the atmospheric pressure $P_{atm}$ and the chamber 5 at the reduced pressure $P_{chamber}$, in which chamber the liquid steel undergoes the desired metallurgical reactions, especially those which are specific to the vacuum treatments. These reactions are essentially:

- a dehydrogenizing reaction, which is relatively easy as its kinetics are favorable;
- a denitriding reaction, the extent of which is generally limited because its kinetics are not very favorable and are strongly dependent on the composition of the metal—the denitriding reaction is slower the higher the sulfur and dissolved-oxygen contents of the steel; purging the liquid steel with argon, which passes through it, and optionally with hydrogen, which is given off from it, is, however, favorable to the denitriding reaction;
- a decarburization reaction, which takes place only if the content of highly deoxidizing elements (aluminum, silicon and manganese) of the pool and the CO partial pressure in the chamber 5 are low enough for the dissolved oxygen contained in the liquid steel 1 present in the chamber 5 to be able to combine with carbon, according to the known laws of thermodynamics; when this decarburization reaction is possible, its kinetics are also favored by the purging due to the argon and to the hydrogen being given off.

The difference in level Δh between the surfaces of the liquid steel pools 1 in the ladle 2 and in the chamber 5 depends on the difference ($P_{atm}-P_{chamber}$) according to the equation:

$$\Delta h = \frac{(P_{atm} - P_{chamber})}{\rho \cdot g}$$

where ρ is the density of the liquid steel (approximately 6900 kg/m$^3$ for a temperature of 1600° C.) and g is the acceleration due to gravity (9.81 m/s$^2$). If, as is generally the case, a pressure of approximately 1 torr (i.e. 133 Pa or $1.33\times10^{-3}$ bar) is maintained in the chamber 5, the difference in level Δh is about 1.5 m.

Preferably, the chamber 5 is equipped with means for injecting argon into the liquid steel 1 that it contains, such as wall nozzles 12 (only one of them has been illustrated, but there may be several of them) or submerged lances. This injected argon, the flow rate of which is generally of the same order of magnitude as the flow rate of gas injected into the ascending snorkel 7 or even slightly higher, increases the rate of degassing and also the rate of the decarburization reaction. This is due to a purging effect of the gases which are present or are formed in the liquid pool 1, and also to the creation of splashes of liquid steel 13 in the form of fine droplets. These droplets 13 present a large specific surface area for exposure to the rarefied atmosphere in the chamber 5, which also causes an increase in the rate of decarburization. The argon injected into the ascending snorkel 7 has a similar effect of creating splashes 13 in the chamber 5. The argon injected into the ladle 2, via the porous plug 14, for homogenizing the liquid steel 1 that it contains may also help to speed up this reaction if the porous plug 14 is placed vertically in line with the ascending snorkel 7. It is also possible to inject oxygen into the liquid steel 1 present in the chamber 5 by means of a emergent lance 15 or of wall nozzles, so as, if necessary, to increase its dissolved-oxygen content in order to enhance the decarburization reaction at the start of the treatment. An injection of oxygen may also be used at certain steps in the treatment in order to reheat the liquid metal 1 by the thermit reaction.

As mentioned, one of the drawbacks of conventional RH reactors, like that illustrated in FIG. 1, is that the ambient air can be drawn into the liquid metal 1 via the pores in the refractories of which the snorkels 7, 8 are composed, and also via the seals separating the bottom 9 of the chamber 5 from the upper ends of the snorkels 7, 8 if the sealing they provide is not perfect. On the one hand, this influx of air causes the liquid metal 1 to be contaminated with nitrogen and oxygen, thereby decreasing the denitriding and inclusion-cleanliness capabilities of the plant, especially if the metal is already deoxidized. On the other hand, the gases drawn in must then be removed by the suction plant 10 which must therefore devote a not insignificant portion of its suction capacity to removing these undesirable gases. This suction capacity would more usefully be employed in removing a larger amount of gas favoring the decarburization kinetics, such as the argon injected via the pipe 11 and the nozzles 12. Likewise, in the absence of this influx of air, it would be possible to choose to keep the same amount of argon injected but to obtain a lower pressure $P_{chaber}$, this also being favorable to extensive degassing and decarburization. Finally, the amount of argon which may be injected into the chamber 5 is limited by the intensity of the splashes 13 which it can tolerate—these splashes 13 must not result in the internal walls of the chamber 5 becoming fouled too rapidly by the creation of a layer 16 of solidified metal.

The plant of the type according to the invention, an example of which is illustrated in FIG. 2, has, in common with the previous one, a ladle 2 which contains the liquid steel 1 to be treated and is fitted with a porous plug 14. According to the invention, during the vacuum treatment the ladle 2 is not exposed to the open air but is put in a vertical enclosure 17 which, in the example illustrated, has a height substantially in excess of that of the ladle 2. The ladle 2 is not placed directly on the bottom of the enclosure 17 but on the platform 18 of a lifting device 19. The enclosure 17 has means 20 for injecting large amounts of an inerting gas, such as argon, into it. Preferably, inside the enclosure 17, there is at least one hopper 21 containing addition elements which it may be desired to add to the liquid steel 1 during its treatment, or mineral materials able to form a synthetic slag intended to cover the surface of the liquid steel 1 present in the ladle 2. A retractable chute 22 allows these materials to be added to the ladle 2, at least when the latter is in the low position. The upper edge of the enclosure 17 consists of a wide horizontal rim 23, having a seal 24 on its upper face.

The plant according to the invention also includes a chamber 25 in which the vacuum treatment of the liquid steel 1 is carried out. In its general principle, this chamber 25 is similar to the conventional RH chamber 5 in FIG. 1. It has two snorkels 26, 27 connected to the bottom 28 of the chamber 25—an ascending snorkel 26, having a duct 29 allowing argon to be taken into its internal space, and a descending snorkel 27 via which the liquid steel returns to the ladle 2 after having passed through the internal space of the chamber 25. A suction plant 30 is used to maintain a pressure $P_{chamber}$ of the order of about 1 torr inside the chamber 25. The chamber 25 is equipped, on its side wall, with wall nozzles 31 for injecting argon, or indeed also with a lance 32 for injecting oxygen. Instead of or in addition to these wall nozzles 31 and this lance 32, there may advantageously be nozzles 33 for injecting argon and/or oxygen into the bottom 28 of the chamber 25; thus, at a given instant, most of the liquid metal 1 present in the chamber 25 can be directly subjected to the action of these gases, and not just the liquid metal 1 which would be vertically in line with the ascending snorkel 26 or in the vicinity of the side wall of the chamber 25.

Figure 2B:
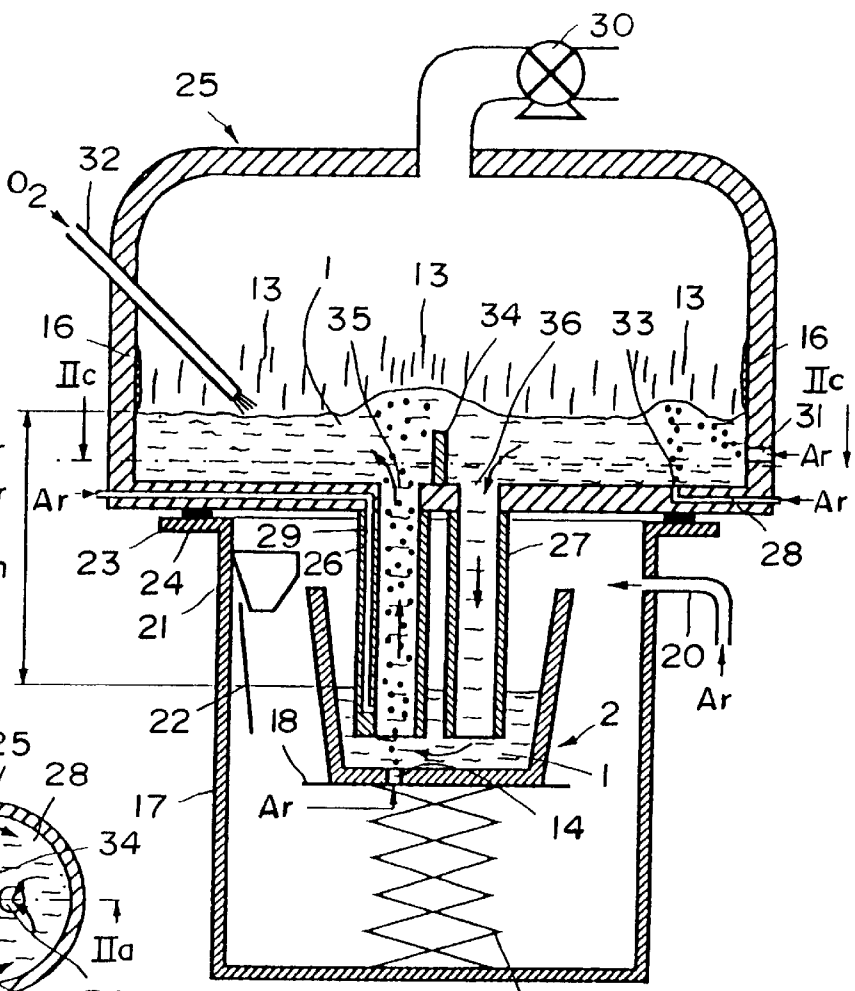
FIG. 2*b* shows it in the same way at a later stage of the treatment and FIG. 2*c* shows it in partial top view in cross section on IIc—IIc.
Figure 2C:
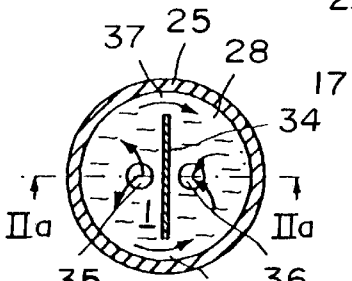
Figure 2A:
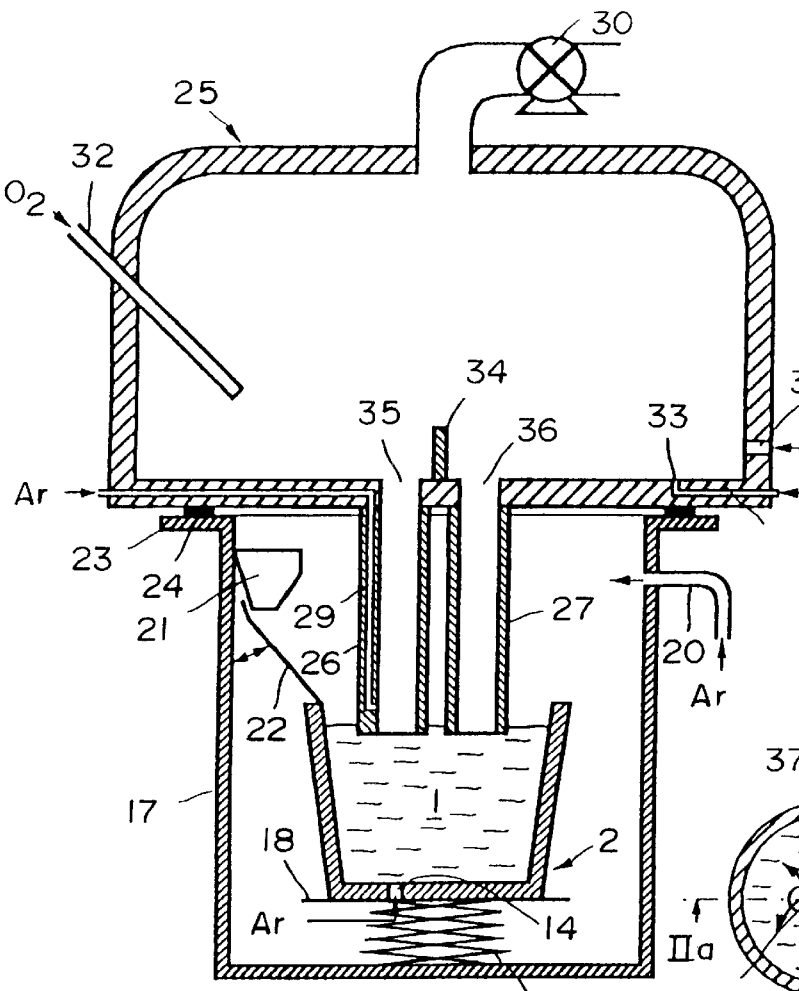
FIG. 2*a* shows it seen from the front in longitudinal section on IIa—IIa at the initial stage of the treatment.

At the start of treatment (the situation in FIG. 2*a*), the chamber 25 is brought above the enclosure 17 and left to rest its entire weight on the rim 23 so that, by virtue of the seal 24, excellent sealing is achieved all around the perimeter of the rim 23. The length of the snorkels 26, 27 is chosen so that at this stage in the treatment, when the lifter 19 on which the ladle 2 rests is in the low position, their lower ends do not dip into the liquid steel 1 contained in the ladle 2 or do so only slightly (as shown in FIG. 2*a*). After putting the chamber 25 in place, a massive amount of argon is then injected into the enclosure 17 by the means 20 provided for this purpose, so as to make the atmosphere in the enclosure 17 non-contaminating for the liquid metal 1.

Once this condition has been achieved, the ladle 2 is raised by means of the lifting device 19 so as to make the snorkels 26, 27 dip more deeply into the liquid steel 1, and at the same time the pressure in the chamber 25 is lowered in order to suck up liquid steel 1 from the ladle 2 into it. The ladle 2 is raised preferably until the lower ends of the snorkels 26, 27 are close to the bottom of the ladle 2. Finally, the process of circulating liquid metal between the ladle 2 and the chamber 25, by injecting argon into the ascending snorkel 26 by means of the duct 29 is started. The supply for this duct 29 must preferably, for greater convenience, remain outside the enclosure 17. For this purpose, as shown, the duct 29 may be made to pass through the bottom 28 of the chamber 25 in order to emerge on the outside of the plant.

Moreover, an amount of argon is injected into the enclosure 17 such that it creates therein a pressure $P_{enclosure}$ significantly greater than the atmospheric pressure, for example from 2 to 3 bar (i.e. from $2\times10^5$ to $3\times10^5$ Pa). Apart from the fact that this overpressure guarantees that air cannot get into the enclosure 17 during the treatment, it has the very important advantage of increasing the difference in level Δh between the surfaces of the liquid steel pools 1 in the 1 ladle 2 and in the chamber 25. Δh is calculated by means of the formula:

$$\Delta h = \frac{(P_{enclosure} \square - \square P_{chamber})}{\rho \cdot g}$$

Again for a pressure of 1 torr (i.e. 133 Pa) in the chamber 25, a pressure of 2 bar in the enclosure 17 (i.e. $2\times10^5$ Pa) creates a difference in level Δh of 2.95 m, and a pressure of 3 bar creates a difference in level of 4.43 m. There is thus the possibility of passing a larger amount of liquid steel 1 into the chamber 25, for a similar plant geometry. FIG. 2*b* illustrates an example of a configuration in which a plant according to the invention may be during a vacuum treatment. Because there is a large difference in level Δh at a given instant, only approximately half the liquid steel 1 which was initially present in the ladle 2 remains therein. The other half, which circulates between the ladle 2 and the chamber 25, is either inside the snorkels 26, 27 or, more significantly, inside the chamber 25 where it is exposed to the reduced pressure which causes the steel to be degassed and, if its composition lends itself thereto, to be decarburized.

Compared with conventional RH reactors, the chamber 25 of the plant according to the invention may have a very significantly greater capacity. In fact, the diameter of its bottom 28 must be at least large enough for the chamber 25 to rest on the rim 23 of the enclosure 17, which means that this diameter must be substantially greater than that of the ladle 2 (unless the bottom 28 is extended laterally by a flange and it is this flange which rests on the rim 23 of the enclosure 17; however, in this case, the particular advantages associated with an increased diameter of the chamber 25, which will be explained below, would be lost). Preferably, a partition 34 made of refractory, placed between the orifices 35, 36 via which the liquid metal enters the chamber 25 and leaves therefrom, dams the bottom of the internal space of the chamber 25 in order to prevent a significant portion of liquid metal 1 entering the chamber 25 via the ascending snorkel 26 from then passing directly into the descending snorkel 27 after having resided only for a short time in the chamber 25. The variation in residence times in the chamber 25 of the various portions of liquid metal 1 is thus reduced. This partition 34 may, as illustrated, have a relatively small height and thus allow the liquid steel 1 to get past it by spilling over when it reaches its nominal height. It may also be high enough to divide the chamber 25 into two compartments which communicate with each other only via empty spaces made between the partition 34 and the internal wall of the chamber 25 and/or via perforations made in the partition 34. As illustrated in FIG. 2*c* such empty spaces 37, 38 and/or perforations may also exist if the height of the partition 34 is small.

If the intention is to leave only a small amount of liquid steel 1 in the ladle 2 when the plant is in operation, the circulatory flow of liquid steel 1 in the ladle 2 causes very intense stirring therein. It is therefore undesirable for there to be slag on the surface of the liquid steel in the ladle 2 during the treatment since this slag would inevitably be entrained into the liquid steel and would compromise its inclusion-cleanliness. Independently of this, the slag may be deposited on the walls of the ladle as the level of metal in the ladle drops. For these reasons, it is strongly recommended that the slag be entirely removed before the ladle is put into the enclosure 17. Once the vacuum treatment has been completed, the plant is returned to its initial configuration, as illustrated in FIG. 2*a*. However, before lifting the chamber 25, in order to vent the ladle 2 to atmosphere in order to transfer it, for example to the casting plant, it is preferable to re-form, on the surface of the liquid steel 1, a layer of synthetic slag so as to immediately protect the metal from atmospheric reoxidation and renitriding reactions and to limit the loss of heat from it by radiation during the subsequent production and casting steps. This layer of synthetic slag may be added, as mentioned, using the hopper 21 and the chute 22. If alloying elements have to be added into the liquid steel 1 during the treatment, this may be achieved using this same hopper or other similar ones, preferably at a moment when there is a relatively large amount of liquid steel 1 in the ladle 2. As a variant, these alloying elements may also be added in the chamber 25 itself, if it is equipped with devices for this purpose, as is generally the case in conventional RH chambers 5. Hoppers may also be provided on the outside of the enclosure 17, combining them with means for transporting the materials through the wall of the enclosure 17. Such an arrangement has the advantage of reducing the necessary internal volume of the enclosure 17 and therefore of reducing the amount of gas necessary to be injected into it in order to inert it or to pressurize it.

As is already known, during part of the treatment it is also possible to inject hydrogen into the liquid steel 1, whether in the ladle 2, the ascending snorkel 26 or the chamber 25, as a replacement of part or all of the argon intended to stir the liquid metal 1 and to speed up the decarburization kinetics or in addition to this argon. Injecting hydrogen into the ladle 2 via the porous plug 14 is particularly advantageous if an overpressure is maintained in the enclosure 17—this overpressure increases the amount of hydrogen which can be dissolved in the liquid steel 1 before it passes into the chamber 25, and therefore the effectiveness of the hydrogen introduction. It is also conceivable to mix the hydrogen with the argon for inerting/pressurizing the enclosure 17, or even by using exclusively hydrogen to temporarily carry out this inerting/pressurizing function. Knowing that hydrogen is an undesirable element in liquid steel when it is being cast, hydrogen introduction into the plant must be stopped before the end of the vacuum treatment so as to give the plant time to reduce the hydrogen content of the liquid steel 1 to an acceptable level during the final phase of the treatment.

The first advantage of the plant according to the invention compared with conventional RH plants is that any sealing defects, which may usually occur at the snorkels and at their connections to the chamber are of no consequence. If such faults do exist in the plant according to the invention, they only result in some of the inerting argon present in the enclosure 17 being drawn in, and not in air being drawn in. There is therefore no contamination of the liquid metal 1 with oxygen and nitrogen from the atmospheric air. In addition, as was mentioned, the suction plant 30 can be used to the best of its capacity since all the gases which it extracts from the chamber 25 either result in the liquid steel 1 being degassed or have helped to speed up this degassing process. This advantage can but be increased if, in addition, the enclosure 17 is maintained at a high inerting gas pressure.

Furthermore, it has recently been established that the difference in level between the site of argon injection into the ascending snorkel and the bottom 28 of the chamber 25 is a particularly important parameter with regard to the flow rate of liquid metal 1 circulating between the ladle and the chamber. This flow rate is greater the larger said difference in level. The plant according to the invention, when it is equipped with long snorkels 26, 27 whose lower ends may be placed very close to the bottom of the ladle 2 and whose point at which argon is injected into the ascending snorkel 26 is very low, makes it possible to optimize this parameter. Compared with a conventional RH reactor that the plant according to the invention would replace, it may be chosen to maintain the same rate of argon injected into the ascending snorkel 26 and thus to increase the rate of circulation of the liquid metal 1. It may also be chosen to maintain the same rate of circulation of the liquid metal 1 while decreasing the rate of argon injected, thereby reducing the wear of the refractories of the ascending snorkel 26.

The other important advantage of the plant is particularly significant if a high overpressure is maintained in the enclosure 17 and if the lower ends of the snorkels 26, 27 can be held close to the bottom of the ladle 2 during the treatment. This is the possibility that, at a given instant during the vacuum treatment, a very high proportion of the liquid metal 1 (for example half) is in the chamber 25 and in the ascending snorkel 26, and therefore is exposed to the reduced pressure and to the intense gaseous purging which are conducive to the degassing and decarburization reactions. Compared with a conventional RH plant, which would treat identical ladles 2 but its chamber could contain only 1/100 to 1/20 of the liquid steel 1 to be treated, the plant according to the invention allows the average residence time of a given portion of the liquid metal 1 in the chamber 25 to be very significantly increased, without increasing the total treatment time. The metallurgical reactions associated with residence of the liquid metal in the chamber 25 under reduced pressure may therefore be carried more extensively.

Moreover, the need to have a chamber 25 of relatively large diameter, so as to completely seal the enclosure 17, has the corollary of giving the liquid steel 1 in the chamber 25 a large specific surface area of exposure to the reduced pressure. What is more, there is the possibility of increasing the number of points at which argon is injected into the chamber 25, especially through its bottom 28. Intense splashes of metal droplets may thus be created practically throughout the chamber 25. Finally, it may be chosen to inject this argon preferably into regions relatively far from the internal wall of the chamber 25, so as to prevent as far as possible the splashes 13 of liquid metal from too rapidly fouling said wall by forming a layer of solidified metal 16. If the power of the suction plant 30 so allows, the amount of argon injected into the vacuum chamber may thus be significantly increased compared with a conventional RH reactor, but without unacceptably increasing the rate of fouling of the walls as a result. All these factors help to increase the reaction surface area of the liquid steel 1 in the chamber 25, this being very conducive to the degassing and decarburization reactions which are desired to be carried out therein, particularly when extremely low hydrogen, nitrogen or carbon contents have already been achieved. Thus, extremely low carbon and nitrogen contents may be achieved in the liquid metal while maintaining the usual productivity of RH plants. It is even possible to obtain kinetic conditions allowing true carbon-induced vacuum deoxidation so as to achieve, simultaneously, very low carbon and oxygen contents. This considerably facilitates the denitriding reaction which is no longer impeded by the dissolved oxygen.

If the length of the snorkels 26, 27 is such that their lower ends are close to the bottom of the ladle 2 when the plant is in use, the lifter 19 and its platform 18 allow the relative positions of the ladle 2 and the chamber 25 to be controlled, as was described previously. The absence of the lifter 19 when putting the chamber 25 in place would require the snorkels 26, 27 to be immersed immediately in the liquid steel 1 over virtually their entire length, and the volume of liquid steel 1 that they would displace would spill out of the ladle 2 if it were used at its rated capacity.

Compared with document JP-A-58,181,818 in which the chamber of the RH reactor has a conventional configuration, placing the ladle in an enclosure and being able to adjust the immersion depth of the snorkels 26, 27 when the plant is in use allows the diameter and the capacity of the chamber 25, and therefore the rate of recirculation, to be considerably increased. The ultralow carbon contents can thus be achieved more easily.

Two examples of a plant according to the invention, with particular dimensions, will now be given. They are applicable to the case in which it is desired to treat a ladle 2 containing 245 t of liquid steel 1 and having an average internal diameter of 3.5 m, corresponding to a surface area of approximately 10 $m^2$ and a metal height of 3.5 m approximately. In both examples, the aim is to provide an amount of metal in the vacuum chamber 25 such that a pool with a depth of 0.5 m is created therein. The rate of argon injected into the ascending snorkel 26 is comparable to that used in the case of a conventional RH treatment applied to the same ladle, i.e. approximately 2.4 $Nm^3$/min. This results in a rate of metal circulation in the snorkels 26, 27 of approximately 120 t/min.

In a first example, a chamber 25 with an internal diameter of 4.4 m (corresponding to a surface area of 15 $m^2$) and snorkels with a length of 2.45 m and an internal diameter of 0.7 m are used. Under these conditions, for a pressure of about 1 torr (133 Pa) in the chamber 25, a pressure difference ($P_{enclosure}-P_{chamber}$) of 2 bar (i.e. $2\times10^5$ Pa) must be created in order to obtain the difference in level Δh of 2.95 m which is needed to obtain the desired pool depth of 0.5 m in the chamber 25. It corresponds to 65.5 t of metal 1 present in the chamber 25 and the snorkels 26, 27.

In a second example, a chamber 25 with an internal diameter of 6.2 m (corresponding to a surface area of 30 $m^2$) and snorkels with a length of 3.26 m and an internal diameter of 0.7 m are used. Under these conditions, for a pressure of about 1 torr (133 Pa) in the chamber 25, a pressure difference ($P_{enclosure}-P_{chamber}$) of 2.55 bar (i.e. $2.55\times10^5$ Pa) must be created in order to obtain the difference in level Δh of 3.76 m which is needed to obtain the intended pool depth of 0.5 m in the chamber 25. It corresponds to 121.5 t of metal 1 in the chamber 25 and the snorkels 26, 27.

In both these examples, a total amount of argon of approximately 20,000 Nl/min. may be injected into the metal 1 present in the chamber 25 by means of the nozzles 31, 33 (this should be compared with the flow rate of about 5000 Nl/min. that a conventional RH plant could tolerate without producing therein excessive splashing of metal against the walls of the chamber).

A variant of the invention consists in providing a metallurgical reactor which is similar to the previous one but which would comprise only a single snorkel connected to the chamber. It would therefore resemble a DH reactor. Since the continuous circulation of liquid metal between the ladle and the chamber is not possible under these conditions (except, limitingly, by natural convection movements, on account of the cooling that the metal undergoes in the chamber), it is therefore necessary:

- either to design the geometry of the plant so that almost all the metal initially present in the ladle passes into the chamber during the treatment so as to limit as far as possible the amount of metal that is not subjected significantly to the vacuum treatment;
- or to replenish the metal in the chamber, by periodically reducing the pressure difference ($P_{enclosure}-P_{chamber}$) or by periodically moving the ladle away from the chamber using the ladle-lifting device.

If very extensive decarburization of the metal is desired, argon injection into the snorkel is very strongly recommended as in the case of conventional DH plants.

A plant according to the invention is inserted into a production line simply by it replacing a conventional RH or DH-type vacuum treatment plant or vacuum chamber, without having to reorganize the meltshop and the general production arrangements set up for grades of ultralow-carbon steel. Finally, just as in conventional RH plants, it may also advantageously treat grades other than ultralow-carbon steels. They would benefit from the lack of contamination of the metal by inducted air, as well as from the increase in the average exposure time to the reduced pressure and to the gaseous purging for a given treatment time. This will particularly make it possible either to obtain more extensive carbon-induced deoxidation, denitriding and dehydrogenation reactions than by means of a conventional RH plant or, for the same metallurgical performance, to reduce the treatment time of the liquid steel.

It goes without saying that the plant described can be used for the vacuum treatment of metals other than liquid steel.

What is claimed is:

1. A metallurgical reactor for the treatment under reduced pressure of a liquid metal, contained in a ladle, comprising:

a chamber connected to a gas-suction plant for maintaining a reduced pressure therein said chamber including a bottom wall, and two tubular snorkels having upper ends extending from said bottom wall and lower ends immersible in said liquid metal contained in said ladle for creating a circulatory motion in the liquid metal between the ladle and the chamber during a reduced pressure treatment, an enclosure containing said ladle and having an upper peripheral edge, said enclosure being provided with a gas injector for creating a pressure greater than atmospheric pressure in the enclosure the upper peripheral edge of the enclosure supporting the bottom wall of the chamber in a sealed manner during said treatment, and a mechanism for raising the ladle toward the chamber during said treatment.

2. A metallurgical reactor for the treatment under reduced pressure of a liquid metal, contained in a ladle, comprising a chamber connected to a gas-suction-plant able to maintain a reduced pressure therein, and one tubular snorkel, the upper end of which emerges in an orifice made in the bottom of the chamber and the lower end of which may be immersed in said liquid metal contained in said ladle, which also comprises an enclosure having an upper peripheral edge which is provided with means for injecting a gas into its internal space, these means being suitable for creating a pressure greater than atmospheric pressure in the enclosure, and the ladle being placed in said enclosure, the upper edge of said enclosure being designed to support the bottom of the chamber in a sealed manner during said treatment, and means for raising the ladle toward the chamber during said treatment.

3. The reactor as claimed in claim 1, wherein the chamber includes an injector for injecting gas into the liquid metal that it contains.

4. The reactor as claimed in claim 3, wherein said injector is provided in the bottom of the chamber.

5. The reactor as claimed in claim 1, wherein the chamber includes a partition placed on said bottom wall for dividing the chamber into two compartments.

6. The reactor as claimed in claim 5, wherein the chamber includes spaces separating the partition from the internal wall of the chamber.

7. The reactor as claimed in claim 1, wherein the enclosure includes an assembly for adding solid materials to the surface of or into the liquid metal contained in the ladle.

8. The reactor as claimed in claim 1, also including a source of hydrogen or a gas mixture containing hydrogen wherein the gas injector for injecting gas into the enclosure injects hydrogen or a gas mixture containing hydrogen.

9. The reactor as claimed in claim 1, wherein the area of said bottom wall of said chamber is larger than an area defied by an upper peripheral edge of said ladle.

* * * * *